United States Patent [19]

Seymour et al.

[11] Patent Number: 4,573,259

[45] Date of Patent: Mar. 4, 1986

[54] METHOD OF MAKING AN AUTOMATED Q-LINE CIRCUIT BREAKER

[75] Inventors: Raymond K. Seymour, Plainville; Joseph M. Palmieri, Southington; William J. Ashline, Bristol; Dennis J. Doughty, Plainville, all of Conn.

[73] Assignee: General Electric Company, New York, N.Y.

[21] Appl. No.: 678,208

[22] Filed: Dec. 5, 1984

Related U.S. Application Data

[62] Division of Ser. No. 561,259, Dec. 14, 1983, Pat. No. 4,513,268.

[51] Int. Cl.[4] ..... H01H 11/00

[52] U.S. Cl. ..... 29/602 R; 29/622

[58] Field of Search ..... 29/602 R, 622; 335/35, 335/23, 191

[56] References Cited

U.S. PATENT DOCUMENTS 4,481,491 11/1984 Heft et al. ..... 335/35 X

*Primary Examiner*—Carl E. Hall

*Attorney, Agent, or Firm*—Richard Menelly; Walter Bernkopf; Fred Jacob

[57] ABSTRACT

A fully automated residential-type circuit breaker assembly is made possible by the provision of retaining slots and guide channels formed within the breaker case. The breaker case then serves as an assembly fixture for specially designed armatures and magnets used within the trip section of the breaker as well as for a special designed bi-metallic trip element. A high calibration yield is accomplished by means of a low friction latch assembly.

1 Claim, 8 Drawing Figures

METHOD OF MAKING AN AUTOMATED Q-LINE CIRCUIT BREAKER

This is a divisional, of application Ser. No. 561,259, filed Dec. 14, 1983 now U.S. Pat. No. 4,513,268.

BACKGROUND OF THE INVENTION

U.S. Pat. No. 3,464,040 to David B. Powell discloses a compact circuit breaker construction for manufacturing one-half inch residential "Q" type circuit breakers. The circuit breaker components are designed for fabrication on mass production equipment and are economically obtained. The assembly of the individual components during the manufacturing process entails some time to assure that the components are interconnected in the proper manner. Further time is required to individually calibrate each breaker to determine whether the breaker trips within a prescribed time interval for a fixed test current. Should a breaker fail to trip within the prescribed time limit, the breaker must be set aside for later calibration. A detailed understanding of the compact breaker components can be obtained by referring to the Powell patent, which is incorporated herein for purposes of reference.

The purpose of the present invention is to provide a residential circuit breaker of economic design which can be completely assembled and tested for calibration in an automated assembly process.

SUMMARY OF THE INVENTION

A residential circuit breaker design for fully automated assembly utilizes a modified molded case with guide channels and retaining slots formed therein so that the case serves as an assembly fixture to facilitate the automated assembly process. An L-shaped magnet and armature assembly, closed loop mechanism spring, and a modified bi-metal trip element allow the breaker components to be robotically assembled within the case guides, channels and retaining slots.

DESCRIPTION OF THE PREFERRED EMBODIMENT

Figure 1:
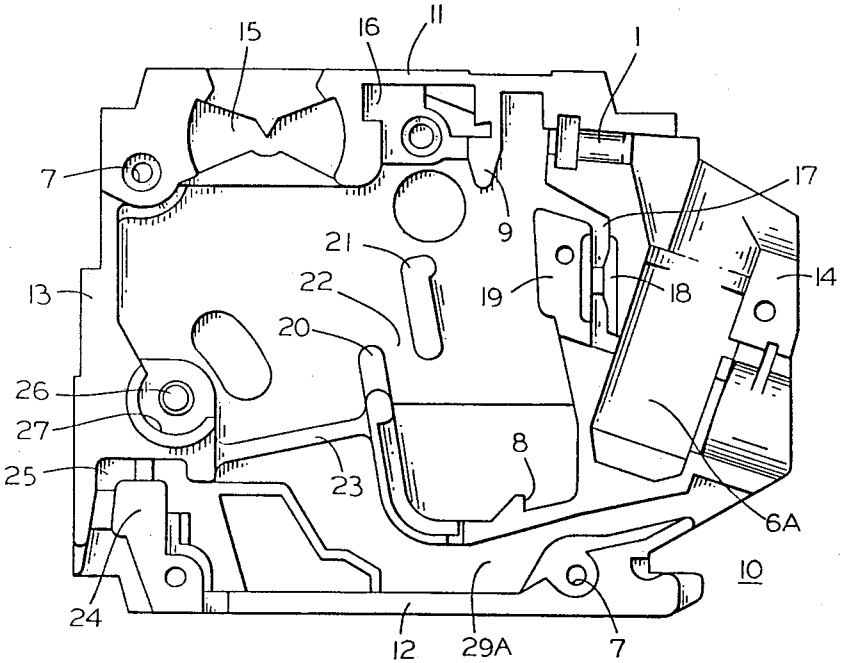
FIG. 1 is a plan view of the case used with the automated circuit breaker according to the invention.
Figure 6:
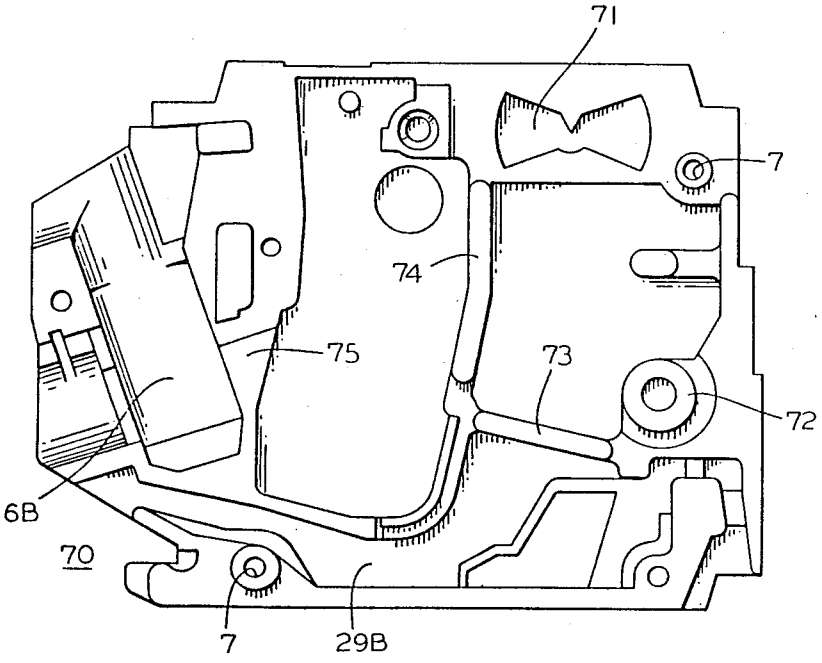
FIG. 6 is a plan view of the cover used with the automated circuit breaker of the invention.
Figure 8:
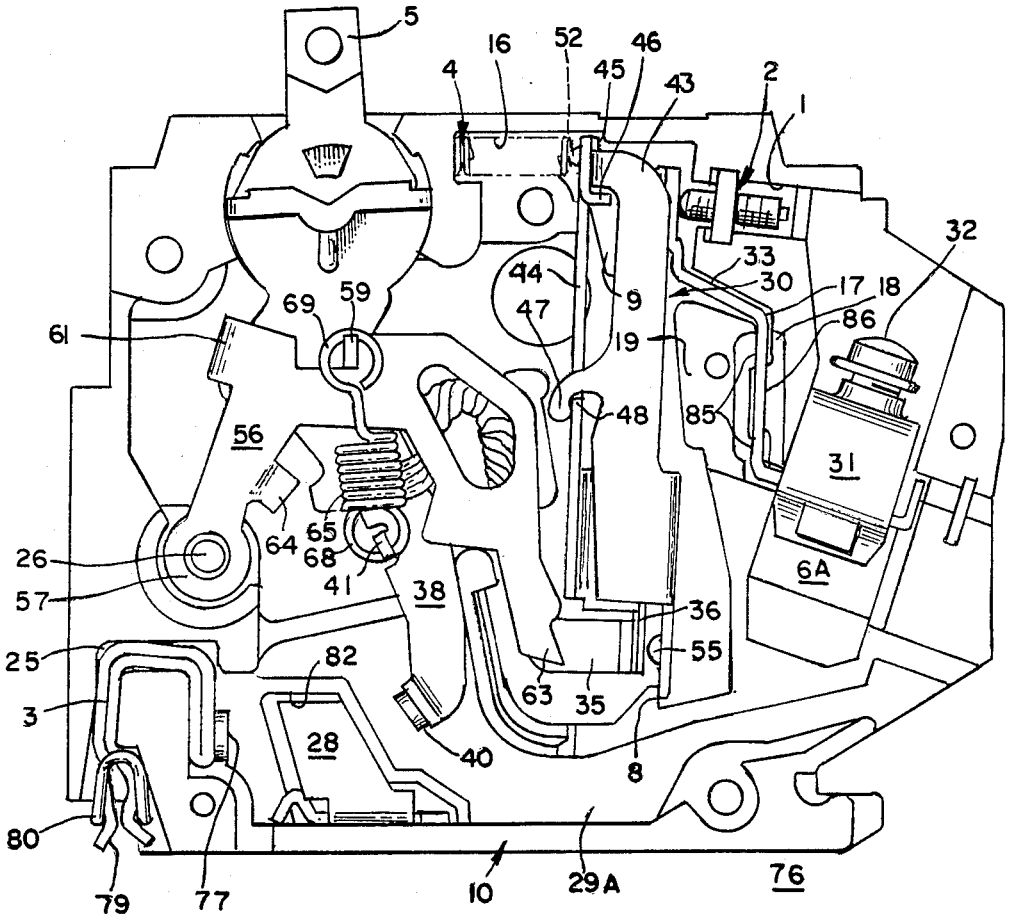
FIG. 8 is a plan view of an assembled compact circuit breaker according to the invention.

The automated circuit breaker case 10, having the retaining slots and guide channels formed for providing a fixture for the robotic assembly of the breaker components is depicted in FIG. 1. The case consists of a raised top rail 11, bottom rail 12, rear rail 13 and front rail 14. A handle recess 15 similar to that disclosed within the aforementioned Powell patent is formed within the case along with a plurality of screw or rivet passages 7. A latch spring retaining slot 16 is formed subjacent top rail 11 along with a calibration screw slot 1. A trip assembly retainer slot 17 is formed between a right barrier 18 as best seen in FIG. 8 and left barrier 19 extending upwards from the case and a terminal lug channel 6A is defined by the bottom of the left barrier 19 and a portion of the angled arc barrier 23. The trip assembly retainer slot includes a pair of bosses 85 extending from left barrier 19 and an opposing abutment 86 on right barrier 18. An arc vent channel 29A is defined between the bottom of the arc barrier and the bottom rail of the case. A magnet stop 8 is integrally formed on a top portion of the angled arc barrier 23 and serves to check the forward motion of the magnet in a manner similar to that described within the Powell patent. A terminal slot 25 is defined between a terminal barrier 24 and a bottom portion of rear rail 13. The cradle, which will be described in detail below, is supported by a raised cradle bearing pivot 26 in combination with a cradle pedestal wall 27. A braid wire and contact blade channel generally indicated at 22 is formed between left and right barriers 20, 21.

Figure 2:
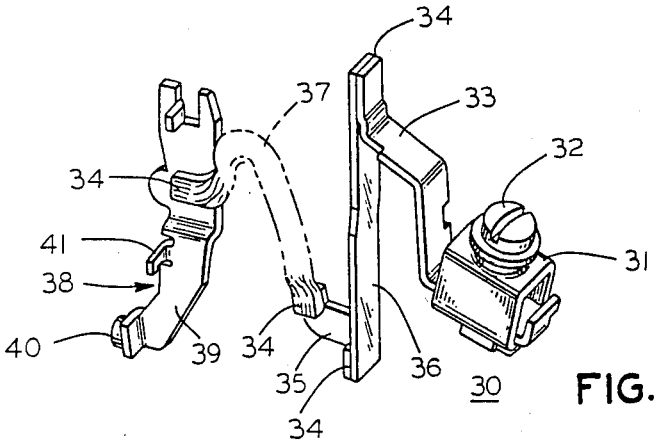
FIG. 2 is a front perspective view of the trip unit and terminal assembly used within the automated circuit breaker of the invention.
Figure 7:
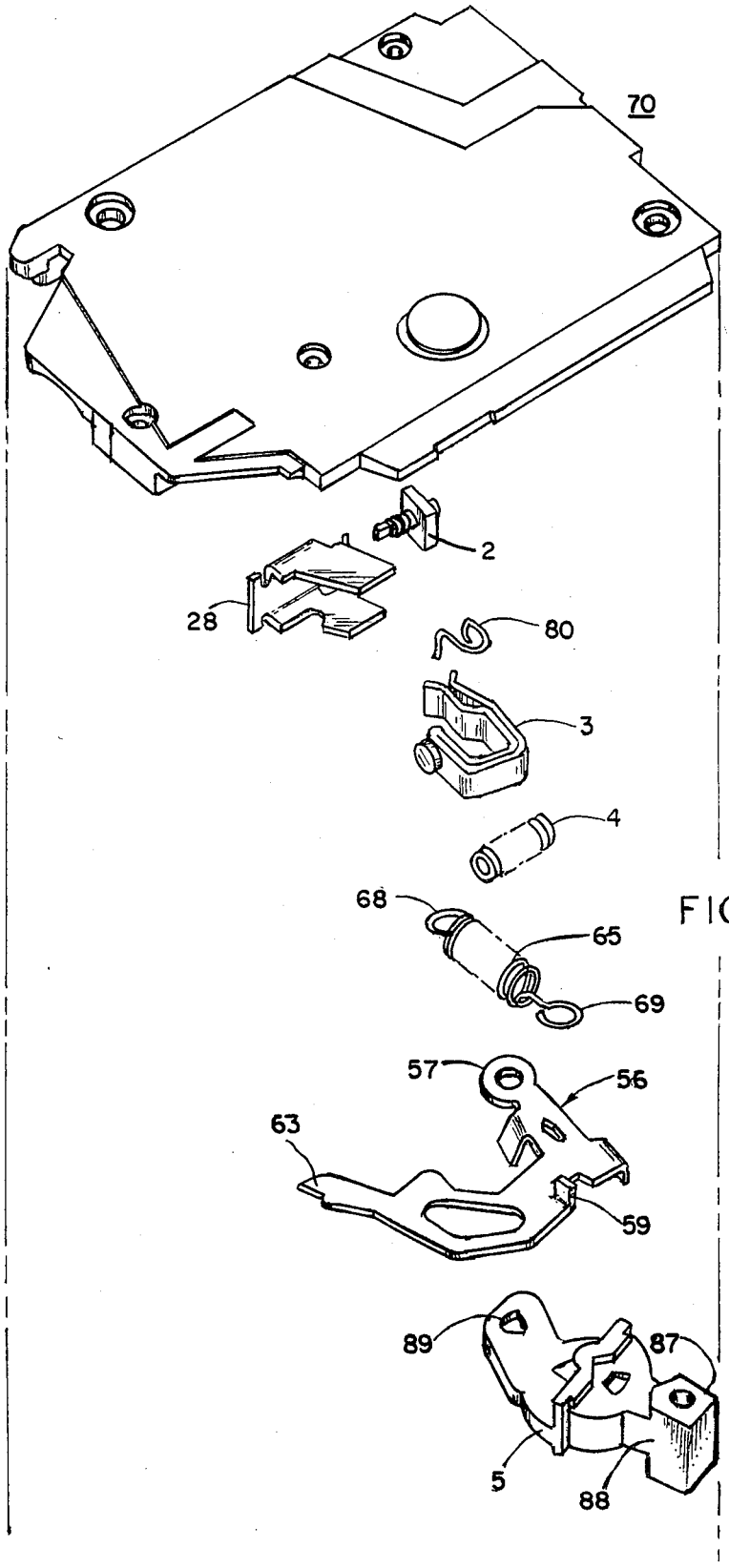
FIG. 7 is a top perspective view in isometric projection of the components used within the automated circuit breaker of the invention arranged in their order of assembly.

A specially designed trip unit and terminal assembly 30 is shown in FIG. 2 and consists of a lug terminal 31 carrying a binding screw 32 and attached to a bi-metal strip 36 by means of an angled connecting strap 33 which is attached to the bi-metal by means of weld 34. The contact blade 38 which includes a yoke end 39A and a raised offset contact end 39B, and contact 40, is attached to a braided conductor 37 by means of weld 34 at one end and to a conductor 35 by means of a weld 34 at an opposite end. A handle cooperating tab 91 is formed from the contact blade at the yoke end to engage within a slot 89 formed within the handle 5 as best seen in FIG. 7. The braid conductor 37 is guided between a pair of tabs 84 extending from the contact blade proximate the weld. This is to constrain the braid from flexing at the weld and to prevent the braid from fraying during blade movement. The conductor 35 is attached to the bi-metal by a weld 34 to complete the assembly. A mechanism spring tab 41 extends from the offset contact end 39B. The trip unit and terminal assembly 30 is retained within case 10 of FIG. 1 by inserting the angled connecting terminal strap 33 within the retainer slot 17 which positions the wire lug 31 within terminal lug chamber 6A and positions contact blade 38 and braid conductor 37 within the braid conductor and contact blade channel 22.

Figure 3:
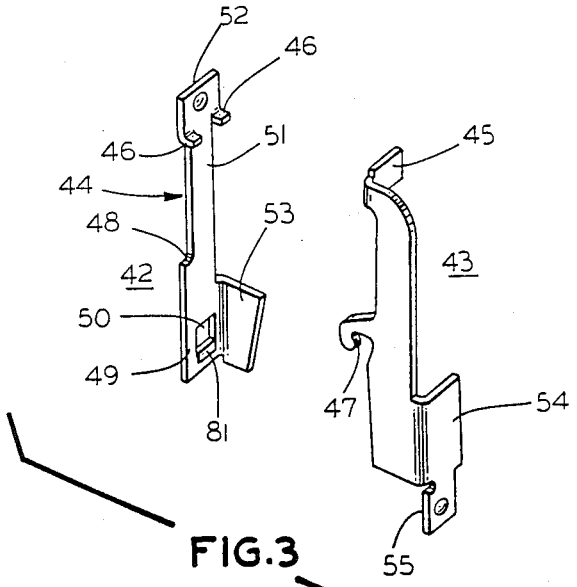
FIG. 3 is a front perspective view of the magnetic assembly including the armature and magnet core used within the automated circuit breaker of the invention.
Figure 4:
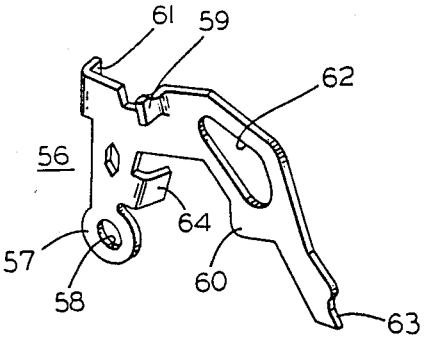
FIG. 4 is a front perspective view of the cradle used within the automated circuit breaker of the invention.
Figure 5:
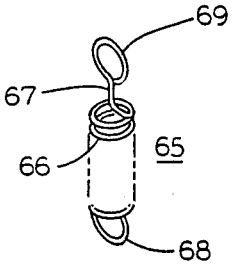
FIG. 5 is a front perspective view of the mechanism spring used within the automated circuit breaker of the invention.

The magnet assembly 42 is shown in FIG. 3 and contains an armature 44 and a magnet core 43. The armature is formed from a single piece of steel and is shaped to provide a pair of tabs 46 which abut the common side wall 9 of calibration screw slot 1 and latch spring slot 16 within the case shown in FIG. 1 and a latch spring boss 52, shown in FIG. 8, which abuts the latch spring slot 16 when the magnet assembly is inserted within the case. The armature contains a narrow top piece 51, a flat bottom piece 49 and angled bottom piece 53 for promoting magnetic transfer between the armature and the magnet core 43. A shelf 48, formed onto the armature, receives and supports a hook extension 47 formed onto the magnet core and assists in maintaining the correct separation distance between the armature and the magnet core. An angled top piece 45 on the magnet core assists in supporting the core within the case and also provides a pivot for the magnet core. An angled bottom piece 54 on the magnet core cooperates with the flat bottom piece 49 and angled bottom piece 53 on the armature to provide a closed magnetic loop which increases the magnetic coupling between the armature and the magnet core. The boss 55 formed on the bottom of the magnet core sets the spacing between the magnet core and the bi-metal 36, shown in FIG. 2, when the magnet assembly is arranged around the bi-metal. The location of the hook extension is important for two reasons. The first purpose of the hook extension 47 is to provide a mechanical coupling between the bi-metal 36 and the armature 44 to cause the armature to move during thermal tripping when the bi-metal contacts boss 55 at the bottom of the magnet 43. This forces the hook extension and the armature to move in unison away from the cradle 56 shown in FIG. 4 during the thermal trip operation. The location of the hook extension proximate the center of the magnet 43 provides close mechanical coupling of the magnet to the armature to allow rapid movement of the armature during the thermal trip operation. However, since the hook extension is part of the magnet core, some magnetic coupling occurs between the hook extension and the armature on the side opposite the angled bottom piece 54. This provides a magnetic force which tends to oppose the motion of the armature toward the magnet during magnetic tripping. The location of the hook extension intermediate the pivotal angled top piece 45 and the end of angled bottom piece 54 substantially reduces the adverse magnetic effect caused by the hook extension since the closer the hook extension is to the pivotal top angled piece, the less the mechanical advantage to oppose the motion of the armature toward the magnet core during the magnetic trip operation. The provision of L-shaped magnet core 43 and L-shaped armature 44 allows the magnet assembly 42 to be inserted "downwardly", that is, with the case 10 of FIG. 1 in the horizontal plane. This was not possible with the magnet assembly described within the Powell patent since the "U-shaped" cross-section therein does not allow for downward assembly of the armature and core about the trip unit. The latch opening 50 formed in the flat bottom piece 49 of the armature supports the cradle latch portion 63 formed at the end of the cradle 56 shown in FIG. 4. The highly polished stainless steel insert 81 at the bottom of latch opening 50 minimizes friction between the cradle latch portion and the armature and permits the cradle latch portion to smoothly slide away from the latch opening when the armature is magnetically attracted to the magnet core during high overcurrent operation or during thermal trip when the bi-metal coupled through the magnet hook moves the armature 44 and latch opening 50 away from the cradle latch portion 63. The consistent performance of the polished insert greatly increases the efficiency of the assembly and calibration process. The cradle is formed from a generally U-shaped body portion 60 having a slotted opening 62. The handle tab 61 and the weld break tab 64 provide similar functions as described for the cradle disclosed within the Powell patent. A mechanism spring tab 59 cooperates with the mechanism spring tab 41 on the contact blade 38 shown in FIG. 2 to support the mechanism spring 65 shown in FIG. 5. To provide a simple and exact method for supporting the cradle pivotally within the case, a circular end member 57 is formed at the end of the U-shaped body 60 opposite the latch portion 63. An opening 58 within the circular end member encompasses the raised cradle bearing pivot 26 formed within the case 10 shown in FIG. 1 and the outside perimeter of the circular end member 57 nests between the raised cradle bearing pivot 26 and the cradle pedestal wall 27 to provide further support to the cradle while pivoting. The mechanism spring 65 shown in FIG. 5 is designed to consist of a body member 66 and a top eye 69 separated a fixed distance by means of a leg extension 67 which engages the mechanism spring tab on the cradle shown in FIG. 4 and a bottom eye 68 for engaging the mechanism spring tab 41 on the contact blade 38 shown in FIG. 2. The provision of top and bottom spring eyes 69, 68 allows the mechanism spring tab 41 on the contact blade and the mechanism spring tab 59 on the cradle to be rapidly engaged by the robot since the robot "fingers" can be inserted within the spring eyes to slightly extend the spring body 66 before dropping the spring eyes 69, 68 over the mechanism spring tabs 41, 59, and withdrawing the robot fingers allowing the tabs to pick up the spring tension exerted by the extension of the spring body. The closed looped eyes provide tangle free springs during part feed to the robot. It was determined that efficient robotic assembly could be achieved by using circular configurations on the circuit breaker components such as the circular end member 57 of the cradle and the spring eyes 69, 68 for engaging with upright extending projections such as the raised cradle retaining pivot 26 on the breaker case in FIG. 1 and the mechanism spring tabs 41, 59 depicted in FIGS. 2 and 4.

As described earlier, the configuration of the trip unit and terminal assembly 30, magnetic assembly 42, cradle 56 and spring 65 shown in FIGS. 2–5 are configured for cooperating with the respective slots formed within the case depicted in FIG. 1 for ease in robotic assembly. Also important in the assemby process is the order in which the circuit breaker components are assembled within the case. This order of assembly is shown in FIG. 7 as follows. The case 10 is positioned in the horizontal plane such that the aforementioned slots are vertically accessible. The armature 44 is assembled first by dropping the armature within the case and orienting the tabs 46 within one edge of the latch spring slot 16 and orienting latch opening 50 in the vertical plane. The trip unit and terminal assembly 30 is assembled next by positioning the trip assembly connecting strap 33 within the trip assembly connecting strap retainer slot 17 such that the teminal lug 31 sits within the terminal lug slot 6A and the contact blade 38 and flexible braid conductor 37 rests within channel 22. The magnet core 43 is then assembled by inserting the angled top piece 45 within the latch spring slot 16 proximate the armature tabs 46 and arranging the angled bottom piece 54 with the bottom piece 49 and angled piece 53 of the armature in a box-like configuration around the trip unit and terminal assembly bi-metal 36. Next, the handle 5 is positioned within the handle recess 15 formed within the case and the cradle 56 is assembled by arranging the cradle circular end member 57 around the raised cradle bearing pivot 26. The handle 5 includes flat portions 87, 88 on either side for carrying indicia as to the "on" or "off" status of the breaker. One portion, such as 87, is color coded red to expose the red color when the handle is in an "on" position, while the other portion 88 is color coded white to expose the white color when the handle is in an "off" position. The mechanism spring 65 cradle spring tab 59 and attaching the mechanism spring is assembled by attaching the spring eye 69 to the eye 68 to the contact blade tab 41. The latch spring 4 is inserted within latch spring slot 16 and engages the latch spring boss 52 on armature 44. The terminal stab assembly 3 is fitted within terminal slot 25 and the terminal stab spring 80 is positioned as indicated in FIG. 8. A pocket channel 82 holds the arc chute 28 trapped between the case and the cover. The calibration screw assembly 2 is press-fit within the calibration screw slot 1, cover 70 is placed over the complete assembly and screws or rivets 83 are applied to fasten the cover to the case. The cover 70 is provided with a plurality of screw passages 7 to receive the screws or rivets 83 and a complimentary handle recess 71 to support the handle 5. The central barrier 74 formed integral with the cover laterally separates the operating mechanism from the trip unit while the angled arc chute barrier 73 separates the arc chute and arc gas vent channel 29B from the trip unit from below. Integrally formed rib 75 holds the terminal stab assembly 3 within the terminal stab assembly chamber 6B. Raised cylinder 72 also integrally formed within the cover provides a bearing surface for the cradle circular end member 57 as best seen in FIGS. 7 and 8.

The assembled compact breaker 76 can be seen by referring to FIG. 8 wherein the cover is removed to expose the assembled components, all of which are tightly engaged within the case 10 such that the completed breaker 76 can be moved without disturbing the placement of any other components. This is an important feature required for robotic assembly since the breaker case and components are often transported on moving conveyor systems during the assembly process before the cover is placed over the case and riveted thereto. In the completed breaker depicted in FIG. 8, the terminal stab assembly 3, stab 79, spring 80 and fixed contact 77 are shown arranged within slot 25. The arc chute 28 is shown located within the arc chute channel 82 intermediate the fixed and movable contacts 77, 40. Also shown is the cradle 56 supportably mounted by means of the circular end 57 encompassing the cradle bearing pivot 26. The mechanism spring 65 is supported by means of the spring tab 41 on the contact blade 38 and the spring tab 59 on cradle 56. The arrangement of the latch spring 4, armature tabs 46 and magnet core top piece 45 are depicted within latch spring slot 16. The trip assembly connecting strap 33 is shown within retainer slot 17 and the terminal lug 31 is shown within the terminal lug channel 6A. The offset bosses 85 cooperate with abutment 86 to capture the strap 33 in a pressfit relation to lockingly hold the trip unit 30 in place during further assembly of the breaker components. This is an important feature of the invention since no other fastening means is required.

We claim:

1. A method for automatically assembling a circuit breaker assembly within a molded plastic circuit breaker case having a plurality of retaining slots and guide channels integrally formed within the case comprising the steps of:

inserting an armature containing a latch opening within a first one of said retaining slots within said case;

positioning a contact blade and trip unit assembly over said armature within said case;

inserting a magnetic core over said trip unit and said armature and positioning a hook extension on said magnetic core over a shelf portion on said armature;

positioning a handle member within a second one of said retaining slots within said case;

inserting a two legged U-shaped cradle member having a circular end member at an end of one of the legs and a latch portion at an end of the other of the legs and positioning the circular end member over a pivot formed within said case and positioning said latch portion in operative relation to said armature latch opening;

arranging a mechanism spring, having a closed loop eye at both ends, between said cradle and said contact blade by engaging one of said spring eyes over a spring tab on said contact blade and engaging the other of said spring eyes over a spring tab on said cradle;

inserting a latch spring within a third one of said retaining slots within said case proximate a top end of said armature;

positioning an arc chute and fixed contact within a fourth recess formed in said case in operational relationship with said contact blade; and fastening a molded plastic cover having a corresponding plurality of slots formed therein over said case whereby said slots formed in said cover cooperate with said slots formed in said case to provide operational clearance for said circuit breaker assembly.

* * * * *